US011202931B2

(12) United States Patent
Yacoboski

(10) Patent No.: US 11,202,931 B2
(45) Date of Patent: Dec. 21, 2021

(54) AQUATIC EXERCISE DEVICE

(71) Applicant: Wayne Joseph Yacoboski, Kyivska oblast (UA)

(72) Inventor: Wayne Joseph Yacoboski, Kyivska oblast (UA)

( * ) Notice: Subject to any disclaimer, the term of this patent is extended or adjusted under 35 U.S.C. 154(b) by 102 days.

(21) Appl. No.: 16/814,518

(22) Filed: Mar. 10, 2020

(65) Prior Publication Data

US 2020/0206555 A1 Jul. 2, 2020

Related U.S. Application Data

(63) Continuation of application No. PCT/UA2018/000046, filed on May 16, 2018.

(51) Int. Cl.

*A63B 21/008* (2006.01)
*A63B 21/00* (2006.01)
*A63B 71/06* (2006.01)

(52) U.S. Cl.

CPC ..... *A63B 21/0084* (2013.01); *A63B 21/0004* (2013.01); *A63B 21/00061* (2013.01); *A63B 21/00069* (2013.01); *A63B 21/4035* (2015.10); *A63B 2071/0694* (2013.01); *A63B 2208/03* (2013.01); *A63B 2210/50* (2013.01); *A63B 2225/60* (2013.01)

(58) Field of Classification Search

CPC ..... A63B 21/0004; A63B 21/00061; A63B 21/00069; A63B 21/0084; A63B 21/0726; A63B 21/4035; A63B 2071/0694; A63B 2208/03; A63B 2210/50; A63B 2225/60

See application file for complete search history.

(56) References Cited

U.S. PATENT DOCUMENTS 4,311,306 A * 1/1982 Solloway ..... A63B 21/00069 482/111
4,416,451 A * 11/1983 Solloway ..... A63B 21/00061 482/111
4,480,829 A * 11/1984 Yacoboski ..... A63B 21/00069 482/108
4,623,142 A * 11/1986 MacKechnie ..... A63B 21/0084 482/111
4,819,951 A * 4/1989 Solloway ..... A63B 21/00061 482/111
5,033,739 A * 7/1991 MacKechnie .... A63B 21/00069 482/111
5,478,312 A * 12/1995 Weissbuch ..... A63B 21/0084 482/111
5,531,657 A * 7/1996 Macedo ..... A63B 21/0084 482/106

(Continued)

FOREIGN PATENT DOCUMENTS

DE 102009003915 A1 5/2010
EP 0170739 A1 2/1986
WO 2015179897 A1 12/2015

*Primary Examiner* — Joshua Lee
(74) *Attorney, Agent, or Firm* — Craft Chu PLLC; Andrew W. Chu

(57) ABSTRACT

An aquatic exercise device is disclosed, able to exert omni-directional uniform water resistance while exercising, so that equal force is required to move it in any direction. The water resistance of the device according to the invention can be adjusted in a quick and measured way. This device can be operated with one hand and can be brought close to the body of exerciser.

21 Claims, 3 Drawing Sheets

(56) References Cited

U.S. PATENT DOCUMENTS

| | | | | |
|---|---|---|---|---|
| 6,962,553 | B2 * | 11/2005 | Stout | A63B 21/0084 482/111 |
| 7,699,759 | B1 * | 4/2010 | Page | A63B 21/00065 482/93 |
| 7,850,497 | B2 * | 12/2010 | Kang | B63H 16/04 440/101 |
| 10,300,320 | B2 * | 5/2019 | Pallesen | A63B 21/0606 |
| 2004/0116256 | A1 * | 6/2004 | Stout | A63B 23/03508 482/55 |
| 2008/0058179 | A1 * | 3/2008 | Stout | A63B 21/0084 482/111 |
| 2017/0136281 | A1 * | 5/2017 | Chipperfield | A63B 21/4035 |

* cited by examiner

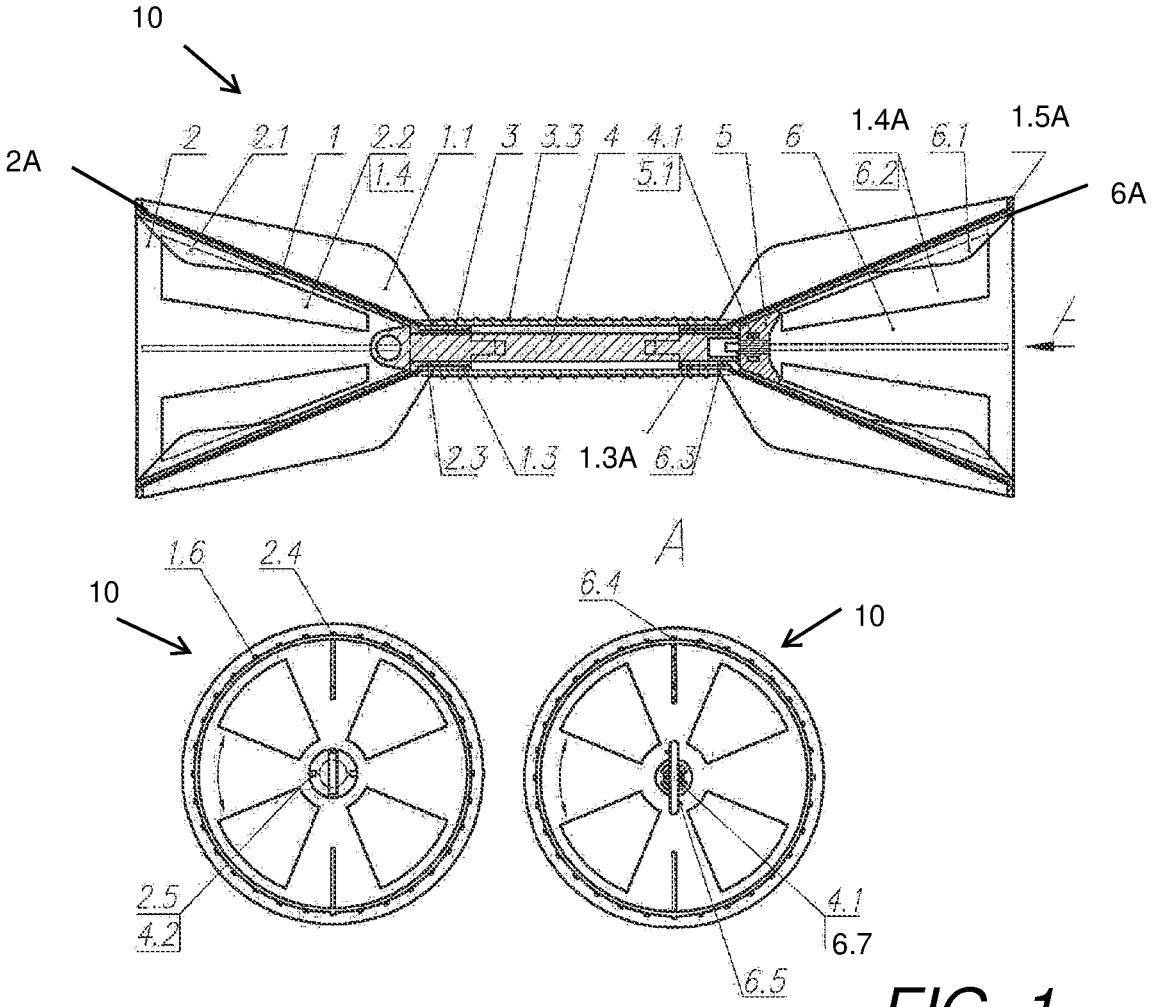
FIG. 1
FIG. 2
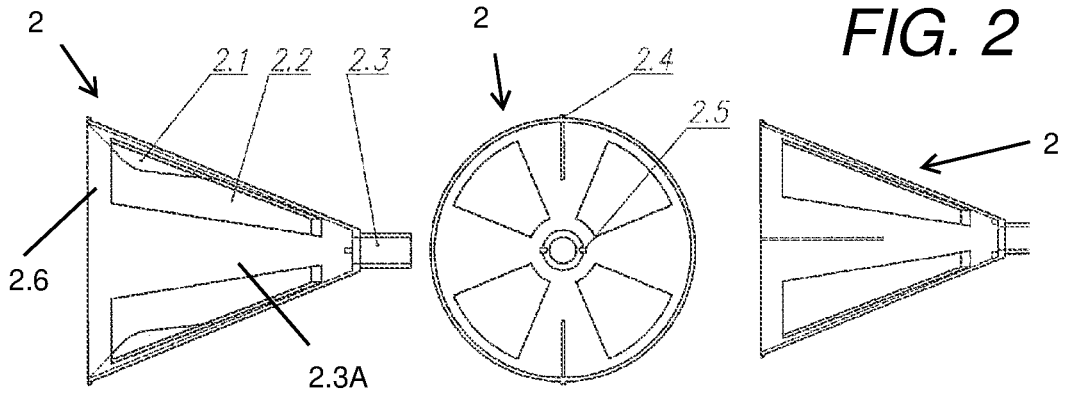

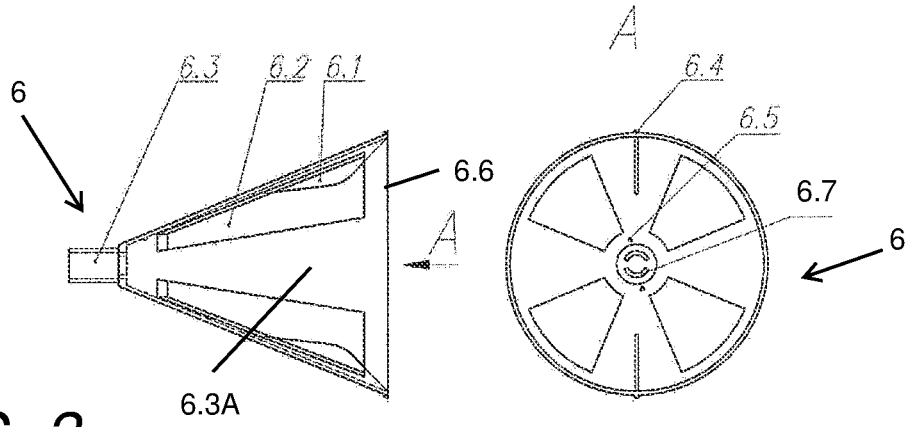
FIG. 3
FIG. 4
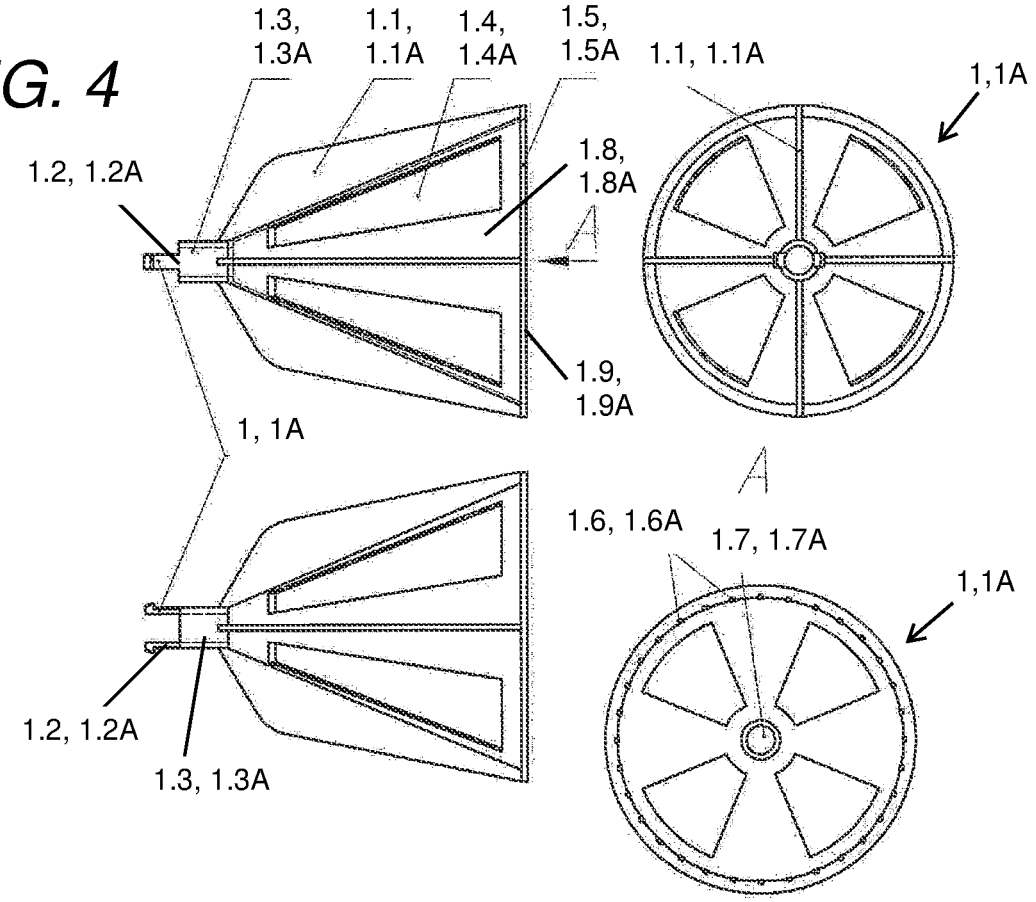

AQUATIC EXERCISE DEVICE

CROSS-REFERENCE TO RELATED APPLICATIONS

This application is a continuation of International Patent Application Serial No. PCT/UA2018/000046, filed May 16, 2018, which is incorporated by reference as if fully set forth. See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to the field of devices for exercises in water or aquatic exercise devices, intended for physical fitness, development of muscles or general body toning exercises performed while immersed in water. Aquatic exercise devices can be broadly described as utilizing water resistance to the movement of such device when immersed, in place of the gravity force or the force of springs (elastic rubber bands etc.). Exercising in water can provide multiple benefits, such as decreasing the apparent weight of an overweight person, lessening the load on a spine of a person in such a need, or just providing general pleasantness of being in water, increasing the comfort of an exercising person, making the experience of exercising more positive, therefore adding to the overall effect of the exercises.

2. Description of Related Art Including Information Disclosed Under 37 CFR 1.97 and 37 CFR 1.98

Among previous achievements in the current technical field, several deserve mention. U.S. Pat. No. 6,962,553, published 8 Nov. 2005 (Stout, 2005), and closely related solutions—U.S. Pat. Nos. 6,955,633, 6,672,993, 7,314,433 disclose dome- or semi-sphere-shaped apertured bell with a handle inside for gripping and fins or resistance plates outside. Such devices are cumbersome, cannot be brought close to the body of the person that is exercising, and do not allow for quick and measured adjustment of water resistance.

U.S. Pat. No. 7,727,123, published 1 Jun. 2010, teaches a water exercise device, characterized by a bar and two resistance mechanisms, attached to opposite ends of the bar, consisting of fins extending radially from the bar, and a dome shaped bell, attached to a distal end of the bar. This device must make use of two different resistance elements resulting in increased bulkiness; it does not allow for quick and measured adjustment of water resistance.

U.S. Pat. No. 4,819,951, published 11 Apr. 1989 (Solloway, 1989) discloses an aquatic exercise device, consisting of a handle bar and fins: transverse end fins, lateral fins and axial fins. Axial fins span the whole length of the bar making the device bulky and cumbersome, and prohibiting bringing it close to one's body when exercising. Neither does this device provide quick and measured adjustment of water resistance.

U.S. Pat. No. 4,623,142, published—18.11.1986 (MacKechnie, 1986) teaches a device for aquatic exercising, consisting of a handle and two funnel shaped supports fixed to the handle from both sides, supporting two types of vanes which differ in size. Seemingly omnidirectional water resistance provided by this device is not however uniform, because vanes of the different size provide substantially different resistance. Furthermore, this device does not provide possibility to adjust water resistance in a quick and measured way.

U.S. Pat. No. 4,480,829, published 6 Nov. 1984 (Yacoboski, 1984), teaches a water exercising device, consisting of two resistance members arranged on opposite ends of a handle, which resistance members comprise each a pair of coaxial discs with sector openings. Fixing these discs in various respective positions allows for adjustment of water resistance. Nevertheless, this device, while being revolutionary in its day, has some limitations. Almost all of the resistance is only available when the paddle face is at 90 degrees to the direction of movement, making some exercises ineffective.

BRIEF SUMMARY OF THE INVENTION

Technical Problem

The field of aquatic exercise devices definitely lacks a device that is able to exert omnidirectional uniform water resistance while exercising, so that equal force is required to move it in any direction; whereby the water resistance of such device would be possible to adjust in a quick and measured way, which device besides would be possible to operate with one hand and to bring close to the body of exerciser.

Solution to Problem

The solution to the above stated problem is achieved by following. Surfaces that offer water resistance, a set of at least three, interspaced with openings at equal angles to each other, are attached to both ends of the handle transversally, cross-axis, and at such an angle, or bent in such a way, that these surfaces resist movement through water in all directions, along the axis of the handle as well as orthogonally to it. In other words, water resistance is exerted either during movements in all planes, parallel to the handle axis, or during movements in the plane, perpendicular to the axis of the handle. Moreover, to each set of (outer) water resistance surfaces at both ends of the handle attached with possibility of rotation there is another (inner) set of water resistance surfaces, interspaced with openings at equal angles to each other, so that openings between water resistance surfaces of inner and outer layers can be opened and closed (or partially closed) depending on degree of the turn. At the same time, bent or angled water resistance surfaces make waisted shape together with the handle.

Advantageous Effects of Invention

The proposed invention achieves easy adjustment of the water resistance in all directions of movement in water together with equal force of resistance, exerted in all directions, having at the same time waisted shape (providing ability to bring the device closer to one's body during exercises) and one hand operability. This combination of capabilities is not achieved by any of the previously disclosed aquatic exercise devices. None at all of the known devices can offer quick and easy adjustment of omnidirectional and uniform water resistance in a measured way, as none of the state of the art devices allows adjustment of water resistance without at least partial disassembling and/or exchange of parts.

BRIEF DESCRIPTION OF THE SEVERAL VIEWS OF THE DRAWINGS

FIG. 1. demonstrates the preferred embodiment of the device according to the invention, assembled, longitudinal section and both side perspectives; the right side perspective is marked with A.

FIG. 2 shows the left inner cone of the preferred embodiment, left side, and, exemplary front and upper perspectives.

FIG. 3 shows the right inner cone of the preferred embodiment, the front and the right side perspective, which is marked with A.

FIG. 4 demonstrates an outer cone of the preferred embodiment of the invention, both side perspectives, front and upper perspectives; an inner side perspective is marked with A.

DETAILED DESCRIPTION OF THE INVENTION

Figure 5:
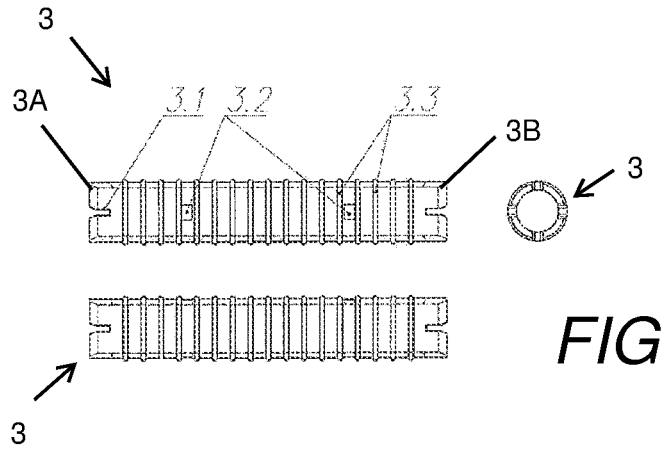
FIG. 5 demonstrates the handle of the preferred embodiment, side, front and upper perspectives.
Figure 6:
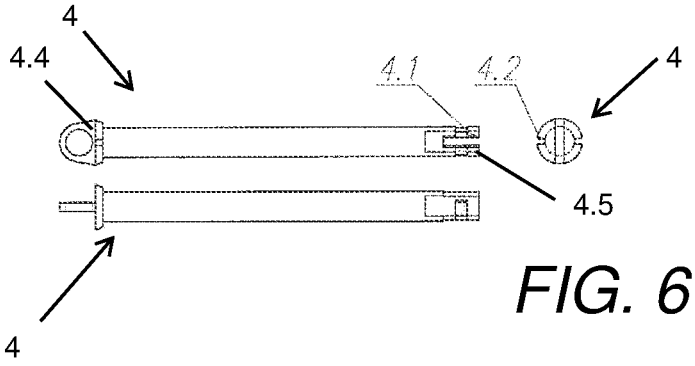
FIG. 6 shows the inner tube of the preferred embodiment, its left side, and exemplary front and upper perspectives.
Figure 7:
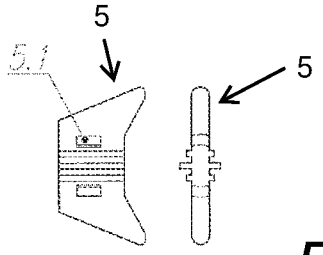
FIG. 7 shows the locking key for the fixing mechanism of the preferred embodiment, its front and right side perspectives.

Best Mode for Carrying Out the Invention

According to the present invention, an exercising device for use by a person who is positioned in water in its preferred embodiment comprises a handle (3) (having a first end 3A and a second end 3B opposite the first end) to be gripped by said person and two water resistance members (a first water resistance member 2A, a second water resistance member 6A) fixed to the ends of said handle. Each water resistance member is shaped as a baseless cone (a first water resistance member as a first baseless cone 2A, a second water resistance member as a second baseless cone 6A) and is fixed to an end of said handle by its apex (a first apex 1.3, a second apex 1.3A. Each said baseless cone-shaped resistance member consists of two coaxial cones, inner (2, left and 6, right) and outer (1), (a first outer coaxial part or cone 1, a first inner coaxial part or cone 2, a second outer coaxial part or cone 1A, a second inner coaxial part or cone 6) such that one can be fitted inside the other in face to face engagement. Each of said coaxial cones has a hub and an outer ring (a first outer coaxial hub 1.3 or cylindrical part of an outer cone or first apex and a first outer ring 1.9 for the first outer coaxial part or cone 1, a first inner coaxial hub 2.3 or cylindrical part of inner cone and a first inner ring 2.6 for the first inner coaxial part or cone 2, a second outer coaxial hub 1.3A or cylindrical part of an outer cone or second apex and a second outer ring 1.9A for the second outer coaxial part or cone 1A, a second inner coaxial hub 6.3 or cylindrical part of inner cone and a second inner ring 6.6 for the second inner coaxial part or cone 6) Said coaxial cones can rotate over each over and have matching cut-outs/apertures (1.4, 2.2, 6.2) (first outer coaxial openings or apertures 1.4 or cut-outs for the first outer coaxial part or cone 1, first inner coaxial openings or apertures 2.2 or cut-outs for the first inner coaxial part or cone 2, second outer coaxial openings or apertures 1.4A for the second outer coaxial part or cone 1A, second inner coaxial openings or apertures 6.2 for the second inner coaxial part or cone 6) so that apertures can be exposed for the water to flow through thus reducing the resistance in the water. Said water resistance members have means for rotating (first outer ring 1.9 and first inner ring 2.6, first outer coaxial hub 1.3 and first inner coaxial hub 2.3 for the first water resistance member 2*a*) (second outer ring 1.9A and second inner ring 6.6, second outer coaxial hub 1.3A and second inner coaxial hub 6.3 for the second water resistance member 6A) one of said coaxial cones relative to the other to vary the registration of apertures in one of the said coaxial cones with apertures in the other thereof to adjust the degree of resistance to movement of said device through water. Said water resistance members also have means for releasably securing (first outer ring 1.9 and first inner ring 2.6, first outer coaxial hub 1.3 and first inner coaxial hub 2.3, first outer notches 1.6 and first inner ridges 2.4 for the first water resistance member 2*a*) (second outer ring 1.9A and second inner ring 6.6, second outer coaxial hub 1.3A and second inner coaxial hub 6.3, second outer notches 1.6A and second inner ridges 6.4 for the second water resistance member 6A) said one coaxial cone in a selected one of a plurality of positions relative to the other so that the relative degree of resistance thereof to said movement is visually indicated and can be varied. The handle (3) of the device is conditioned to be gripped at any location around the periphery thereof so that said device can be moved through water in any plane.

The device according to this invention in its preferred embodiment is further characterized so that said outer cones (1) (1A) may be fixed to said handle by a clip mechanism (3.2, handle and 1.2, outer cone) (first outer clip 1.2, second outer clip 1.2A, clip openings 3.2 in the handle 3) for easy disassembling. The preferred embodiment of the invention further may have the inner cones (2, left and 6, right) at both ends of said handle (belonging to opposite resistance members) connected to each other using an inner tube (4) which can move within the said handle (3), locked with a fixing mechanism (5A). The preferred embodiment of the invention can further have clips (1.2) (1.2A) fixed in place using the inner tube (4) that connects the two inner cones (2, left and 6, right), and the fixing mechanism (5A) comprises a locking key (5). The preferred embodiment of the invention may further have ridges (2.4) on inner cones (2, left and 6, right) (first inner ridges 2.4 on the first inner coaxial cone 2, second inner ridges 6.4 on the second inner coaxial cone 6) that interfere with notches (1.6) in the outer cones (1) (first outer notches 1.6 on the first outer coaxial cone 1, second outer notches 1.6A on the second outer coaxial cone 1A) around the outer rim of the inner cones (2, left and 6, right), and said ridges provide a "click" effect to enable the selection of a number of openings and thereby a corresponding number of resistances. The number of said resistances for the preferred embodiment of the invention may be four. The preferred embodiment of the invention may additionally have ribs (first outer ribs 1.1, second outer ribs 1.1A) or fins (first inner fins 2.1, second inner fins 6.1) arranged along outer (1.1) and/or inner cones (2.1) in symmetric fashion relative to the handle axis. The preferred embodiment may additionally have flanges (first outer flange 1.5, second outer flange 1.5A) across cones and/or along outer ring (1.5), arranged in symmetric fashion relative to the handle axis.

Other Embodiments

Other possible embodiments of the present invention include an aquatic exercising device that comprises: a handle 3 (having a first end 3A and a second end 3B opposite the first end) to be gripped by an exercising person; two water resistance members (a first water resistance member 2A, a second water resistance member 6A) fixed to the opposite ends of said handle, each said water resistance member consisting of two coaxial parts, inner and outer, so that one can be fitted inside the other in face to face engagement; each of said parts having a hub and a number of vanes, at least three, fixed to the hub in transverse fashion relative to the handle, radiating outwardly from said hub at equal angles to each other, thereby forming openings between them (a first outer coaxial part or cone 1 with first outer coaxial vanes 1.8, a first inner coaxial part or cone 2 with first inner coaxial vanes 2.3A, a second outer coaxial part or cone 1A with second outer coaxial vanes 1.8A, a second inner coaxial part or cone 6 with second coaxial vanes 6.3A) (a first outer coaxial hub 1.3 or cylindrical part of an outer cone or first apex and a first outer ring 1.9 for the first outer coaxial part or cone 1, a first inner coaxial hub 2.3 or cylindrical part of inner cone and a first inner ring 2.6 for the first inner coaxial part or cone 2, a second outer coaxial hub 1.3A or cylindrical part of an outer cone or second apex and a second outer ring 1.9A for the second outer coaxial part or cone 1A, a second inner coaxial hub 6.3 or cylindrical part of inner cone and a second inner ring 6.6 for the second inner coaxial part or cone 6); means for rotating one of said parts relative to the other so as to vary the registration of openings of one of the said parts with openings of the other thereof so as to adjust the degree of resistance to movement of each of said members through water; whereby the said vanes are angled and/or bent relative to the handle in such a way that they are able to provide water resistance simultaneously in the coaxial direction to the handle and in at least three directions, at equal angles to each other, perpendicular to the handle axis; said water resistance members also comprising means for releasably securing said one part in a selected one of a plurality of positions relative to the other part so that the relative degree of resistance thereof to said movement is visually indicated and can quickly be varied; said handle being conditioned to be gripped at any location around the periphery thereof so that said members can be moved through water in any plane from parallel thereto to normal thereto.

In an embodiment of the present invention, the aquatic exercise device may have said vanes bent in a semicircular shape. In another embodiment of the present invention, the aquatic exercise device may have said vanes angled to the said hub as to form a cone. In another embodiment of the present invention, an aquatic exercise device may have said vanes bent in a shape of semi cylinder. Another variant embodiment of the present invention is an aquatic exercise device that has said vanes bent in a bowl-like shape. Another embodiment of an aquatic exercise device according to the present invention can have said vanes bent in a bowl-like shape. An aquatic exercise device according to the present invention in yet another embodiment may have said vanes of a said coaxial part of a water resistance member, joint together with connective links (first outer coaxial connective link 1.5, 1.6, 1.9, first inner coaxial connective link 2.6 2.4, second outer coaxial connective link 1.5A, 1.6A, 1.9A, second inner coaxial connective link 6.6, 6.4). An aquatic exercise device according to the present invention may further have said connective links joint together as a ring (first outer ring 1.9, first inner ring 2.6, second outer ring 1.9A, second inner ring 6.6). Further variant of the aquatic exercise device according to the present invention, is where said connective links, joint together as a ring, form means for releasably securing said one coaxial part of a water resistance member in a selected one of a plurality of positions relative to the other coaxial part. Another variant of the present invention is the aquatic exercise device, where said means for releasably securing said one coaxial part of a water resistance member in a selected one of a plurality of positions relative to the other coaxial part, may be formed with the hubs of the said coaxial parts of a water resistance member. The aquatic exercise device according to the present invention in a further embodiment may have means to connect opposite inner coaxial parts together inside the handle as to enable simultaneous change of positions relative to the corresponding outer coaxial parts of the opposite water resistance members. An aquatic exercise device according to the present invention in yet another embodiment may have ribs (first outer ribs 1.1, second outer ribs 1.1A) or fins (first inner fins 2.1, second inner fins 6.1) on water resistance members arranged along said vanes in symmetric fashion relative to the handle axis. An aquatic exercise device in a further variant of the present invention may have additional flanges (first outer flange 1.5, second outer flange 1.5A) arranged across said vanes and/or said connective links and/or said ring made of joint links, arranged in symmetric fashion relative to the handle axis. Said water resistance members of an aquatic exercise device according to another embodiment of the present invention can be detached for storage or transportation or to be replaced with a smaller or larger set of water resistance members to increase the range of water resistance adjustment. In a further embodiment of the present invention the said coaxial parts of water resistance members may be similarly formed.

INDUSTRIAL APPLICABILITY

The way this invention can be used is best described utilizing as an example the preferred embodiment, but the following indication should not be understood as limiting. For example, the preferred embodiment of an aquatic exercise device according to the invention may be manufactured from polypropylene, but the present invention must not be limited by this material, because a number of materials suitable for manufacturing of an aquatic exercise device according to the present invention are known to a specialist in the field. The device according to the invention is assembled attaching outer cones (1) to the handle (3), whereby the ribs (1.1) of the outer cones connect with notches (3.1) in the handle, while clips (1.2) of outer cones lock on the holes (3.2) in the handle. The notches and clips are in place for fixing the outer cones and avoiding their rotation inside the handle during vigorous exercises. The cylindrical part (1.3) of the outer cones transfers the stress on the handle, avoiding stressing and destruction of the locking mechanism. On the next step the inner cones (2, 6) are assembled, inserting cylindrical cone parts (2.3, 6.3) into the void (1.7) of respective cylindrical parts of the outer cones (1.3); care is taken to arrange them in the similar position in relation to the closure of the openings (1.4, 2.2, 6.2). Thus, the inner cones keep the clips (1.2) in place (3.2) with the help of their cylindrical parts (2.3, 6.3). The assembly is concluded by passing the inner tube (4) through the cylindrical parts of the inner cones (2.3, 6.3), whereby protrusions (2.5) of the left inner cone apex insert in the notches (4.2) in the left end of the tube; at the same time the right, locking end of the inner tube (4.1) passes through locking holes (6.7), is closed by the key (5) by passing locking end of the inner tube (4.1) through its holes (5.1) and "clicking" the key over the bulges (6.5) (second inner coaxial protrusions 6.5) on the apex of the right cone (6).

Dismantling of the device according to the invention, exemplified by the preferred embodiment, is done in reversed order.

Likewise a change of cone size is done. The cones can easily be scaled to provide a range of resistances so they can meet the requirements of any user.

The adjustment of the water resistance is done by "clicking" of ridges (2.4, left inner cone, 6.4, right inner cone) until preferable position is reached.

Exercising in the water is done by gripping the handle by a hand of exercising person and performing necessary movements. Secure grip of the handle in water is facilitated by ribbing (3.3) on the handle.

In addition ribs (fins) along the side of the cones (1.1, 1.1A 2.1, 6.1) further disrupt the water flow so increasing the frontal resistance.

The use of a cone and the clip mechanism is designed so that the product could easily be disassembled for cleaning. As was identified through the practical use, the aquatic exercising device according to Yacoboski, 1984, could get dirt, grit or sand in it and if that happened the adjustment mechanism would lock because the particles would prevent the movement of the adjusting disk and cleaning of the device was difficult. The preferred embodiment of the device according to the present invention is among others designed to be dis-assembled. In addition the use of a cone means that even if the parts have become locked together the can be easily freed as the cone within a cone releases naturally due to the nature of the geometry.

The end of the cone of the preferred embodiment of the invention features a return flange (1.5) (1.5A). The return flange is used to help balance the force in each direction as is mentioned above. It is also there to provide additional strength to the outer molding so that it would withstand a level of impact. In addition, it provides greater rigidity to that element, with the stiffness important in getting the "click" required as the inner cone is turned.

The waisted shape of the preferred embodiment of the invention is designed to enable the device to be brought close to the body of the user to facilitate exercises. The preferred embodiment of the invention can also have handle interlocking mechanism, which is disclosed lower. The handle and outer cones clip together for easy assembly. However, there can be significant force applied to the assembly when in the water during vigorous exercise. The fixing mechanism locks the clips in place using the inner tube that connects the two inner cones. This means that the force is not transferred to the clips and the unit does not come apart if the clips break.

Because of the unique design functionality, the device can be moved through a variety of movements in many different planes and angles of attack while maintaining desired resistances without ever having to change the position of the hands on the grip. This allows the user to train different muscle groups associated with each targeted exercise much more quickly and efficiently.

REFERENCE SIGNS LIST

1—outer cone, first coaxial part, first coaxial cone, 1A second coaxial part, second coaxial cone
1.1—ribs/fins along an outer cone, first outer ribs, 1.1A second outer ribs
1.2—clips, first outer clip, 1.2A second outer clip
1.3—cylindrical part of an outer cone, first outer coaxial hub, first apex, 1.3A second outer coaxial hub, second apex
1.4—cut-outs/apertures in an outer cone, first outer coaxial openings, first outer coaxial apertures, 1.4A second outer coaxial openings, second outer coaxial apertures
1.5—return flange at the end of an outer cone, first outer flange, 1.5A second outer flange
1.6—notches on an outer cone, first outer notches, 1.6A second outer notches
1.7—void of the cylindrical part of an outer cone left inner cone, first inner coaxial part, first inner coaxial cone
2.1—ribs/fins along the left inner cone, first inner fins
2.2—cut-outs/apertures in the left inner cone, first inner coaxial openings
2.3—cylindrical part of the left inner cone, first inner coaxial hub, 2.3A first inner coaxial vanes
2.4—ridges on the left inner cone, first inner ridges
2.5—protrusions of the left inner cone, first inner coaxial protrusions on the first inner coaxial hub 2.3
2.6—first inner ring
3—handle
3.1—notches in the handle, handle notches
3.2—clip openings in the handle
3.3—ribbing
4—inner tube having first inner tube end 4.4 and second inner tube end 4.5
4.1—locking end of the inner tube
4.2—notches in the left end of the tube, inner tube notches
5—locking key
5.1—locking key holes
6—right inner cone, second inner coaxial part, second inner coaxial cone
6.1—ribs/fins along the right inner cone, second inner fins
6.2—cut-outs/apertures in the right inner cone, second inner coaxial openings
6.3—cylindrical part of the right inner cone, second inner coaxial hub, 6.3A second inner coaxial vanes
6.4—ridges on the right inner cone, second inner ridges
6.5—bulges on the apex of the right inner cone, second inner coaxial protrusions on the second inner coaxial hub 6.3
6.7—locking holes of the right inner cone
6.6—second inner ring

What is claimed is:

1. An exercising device for use in water comprising:

a handle having a first end and a second end opposite said first end;

a first water resistance member being fixed to said first end of said handle and being comprised of a first outer coaxial part, and a first inner coaxial part fitted inside said first outer coaxial part, wherein said first outer coaxial part is comprised of a first outer coaxial hub and a plurality of at least three first outer coaxial vanes, each first outer coaxial vane being fixed to said first outer coaxial hub in transverse fashion relative to said handle and radiating outwardly from said first outer coaxial hub at equal angles to each other so as to form first outer coaxial openings between adjacent first outer coaxial vanes of said plurality of at least three first outer coaxial vanes, and wherein said first inner coaxial part is comprised of a first inner coaxial hub and a plurality of at least three first inner coaxial vanes, each first inner coaxial vane being fixed to said first inner coaxial hub in transverse fashion relative to said handle and radiating outwardly from said first inner coaxial hub at equal angles to each other so as to form first inner coaxial openings between adjacent first inner coaxial vanes of said plurality of at least three first inner coaxial vanes;

a second water resistance member being fixed to said second end of said handle and being comprised of a second outer coaxial part, and a second inner coaxial part fitted inside said second outer coaxial part, wherein said second outer coaxial part is comprised of a second outer coaxial hub and a plurality of at least three second outer coaxial vanes, each second outer coaxial vane being fixed to said second outer coaxial hub in transverse fashion relative to said handle and radiating outwardly from said second outer coaxial hub at equal angles to each other so as to form second outer coaxial openings between adjacent second outer coaxial vanes of said plurality of at least three second outer coaxial vanes, and wherein said second inner coaxial part is comprised of a second inner coaxial hub and a plurality of at least three second inner coaxial vanes, each second inner coaxial vane being fixed to said second inner coaxial hub in transverse fashion relative to said handle and radiating outwardly from said second inner coaxial hub at equal angles to each other so as to form second inner coaxial openings between adjacent second inner coaxial vanes of said plurality of at least three second inner coaxial vanes;

means for rotating said first inner coaxial part relative to said first outer coaxial part so as to vary registration of said first outer coaxial openings with said first inner coaxial openings and a degree of resistance to movement of said first water resistance member;

means for rotating said second inner coaxial part relative to said second outer coaxial part so as to vary registration of said second outer coaxial openings with said second inner coaxial openings and a degree of resistance to movement of said second water resistance member, wherein each of the first outer coaxial vanes, the first inner coaxial vanes, the second outer coaxial vanes, and the second inner coaxial vanes are angled relative to said handle so as to provide water resistance simultaneously in a coaxial direction with said handle and in at least three directions, at equal angles to each other, perpendicular to said coaxial direction of said handle;

means for releasably securing said first inner coaxial part in a plurality of positions relative to said first outer coaxial part so as to indicate said degree of resistance to movement of said first water resistance member;

means for releasably securing said second inner coaxial part in a plurality of positions relative to said second outer coaxial part so as to indicate said degree of resistance to movement of said second water resistance member; and means to connect said first inner coaxial part and said second inner coaxial part inside said handle as to enable simultaneous change said degree of resistance to movement of said first water resistance member and said degree of resistance to movement of said second water resistance member.

2. The exercising device according to claim 1, wherein each of the first outer coaxial vanes, the first inner coaxial vanes, the second outer coaxial vanes, and the second inner coaxial vanes are semicircular.

3. The exercising device according to claim 1, wherein each of the first outer coaxial vanes, the first inner coaxial vanes, the second outer coaxial vanes, and the second inner coaxial vanes are angled to a respective first outer coaxial hub, first inner coaxial hub, second outer coaxial hub, and second inner coaxial hub as to form a corresponding cone.

4. The exercising device according to claim 1, wherein each of the first outer coaxial vanes, the first inner coaxial vanes, the second outer coaxial vanes, and the second inner coaxial vanes are semi cylindrical.

5. The exercising device according to claim 1, wherein each of the first outer coaxial vanes, the first inner coaxial vanes, the second outer coaxial vanes, and the second inner coaxial vanes are bowl-shaped.

6. The exercising device according to claim 1, wherein the first outer coaxial vanes of the first outer coaxial part are joined together with a first outer coaxial connective link, wherein the first inner coaxial vanes of the first inner coaxial part are joined together with a first inner coaxial connective link, wherein the second outer coaxial vanes of the second outer coaxial part are joined together with a second outer coaxial connective link, and wherein the second inner coaxial vanes of the second inner coaxial part are joined together with a second inner connective link.

7. The exercising device according to claim 6, wherein said first outer coaxial connective link is comprised of a first outer ring, wherein said first inner coaxial connective link is comprised of a first inner ring, wherein said second outer connective link is comprised of a second outer ring, and wherein said second inner connective link is comprised of a second inner ring.

8. The exercising device according to claim 7, wherein said means for releasably securing said first inner coaxial part in a plurality of positions relative to said first outer coaxial part is comprised of said first outer ring and said first inner ring, and wherein said means for releasably securing said second inner coaxial part in a plurality of positions relative to said second outer coaxial part is comprised of said second outer ring and said second inner ring.

9. The exercising device according to claim 7, wherein said first outer coaxial connective link is further comprised of a first outer flange, wherein said first inner coaxial connective link is further comprised of a first inner flange, wherein said second outer connective link is further comprised of a second outer flange, and wherein said second inner connective link is comprised of a second inner flanges.

10. The exercising device according to claim 1, wherein said means for releasably securing said first inner coaxial part in a plurality of positions relative to said first outer coaxial part is comprised of said first outer coaxial hub and said first inner coaxial hub, and wherein said means for releasably securing said second inner coaxial part in a plurality of positions relative to said second outer coaxial part is comprised of said second outer coaxial hub and said second inner coaxial hub.

11. The exercising device according to claim 1, further comprising:

first outer ribs along the first outer coaxial vanes and in symmetrical arrangement coaxial to said handle, first inner fins along said first inner coaxial vanes and in symmetrical arrangement coaxial to said handle, second outer ribs along said second outer coaxial vanes and in symmetrical arrangement coaxial to said handle, and second inner fins along said second inner coaxial vanes and in symmetrical arrangement coaxial to said handle.

12. The exercising device according to claim 1, wherein said first water resistance member is removably fixed to said first end of said handle, and wherein said second water resistance member is removably fixed to said second end of said handle.

13. The exercising device according to claim 1, wherein said first inner coaxial part and said first outer coaxial part are similar to said second inner coaxial part and said second outer coaxial part.

14. An exercising device for use in water comprising:

a handle having a first end and a second end opposite said first end;

a first water resistance member being fixed to said first end of said handle and being shaped as a first baseless cone with a first apex, said first apex being attached to said first end of said handle, wherein said first baseless cone is comprised of a first outer coaxial cone and a first inner coaxial cone fitted inside said first outer coaxial cone, wherein said first outer coaxial cone is comprised of a first outer coaxial hub, first outer coaxial apertures, and a first outer coaxial ring, wherein said first inner coaxial cone is comprised of a first inner coaxial hub, first inner coaxial apertures, and a first inner coaxial ring, a second water resistance member being fixed to said second end of said handle and being shaped as a second baseless cone with a second apex, said second apex being attached to said second end of said handle, wherein said second baseless cone is comprised of a second outer coaxial cone and a second inner coaxial cone fitted inside said second outer coaxial cone, wherein said second outer coaxial cone is comprised of a second outer coaxial hub, second outer coaxial apertures, and a second outer coaxial ring, wherein said second inner coaxial cone is comprised of a second inner coaxial hub, second inner coaxial apertures, and a second inner coaxial ring, means for rotating said first inner coaxial cone relative to said first outer coaxial cone so as to vary registration of said first outer coaxial apertures with said first inner coaxial apertures and a degree of resistance to movement of said first resistance member;

means for rotating said second inner coaxial cone relative to said second outer coaxial cone so as to vary registration of said second outer coaxial apertures with said second inner coaxial apertures and a degree of resistance to movement of said second resistance member;

means for releasably securing said first inner coaxial cone in a plurality of positions relative to said first outer coaxial cone so as to indicate said degree of resistance to movement of said first water resistance member; and means for releasably securing said second inner coaxial cone in a plurality of positions relative to said second outer coaxial cone so as to indicate said degree of resistance to movement of said second water resistance member.

15. The exercising device according to claim 14, further comprising a first outer clip fixed to said first outer coaxial cone and said first end of said handle; and a second outer clip fixed to said second outer coaxial cone and said second end of said handle.

16. The exercising device according to claim 15, further comprising:

an inner tube having a first inner tube end and a second inner tube end opposite said first inner tube end and being movably positioned within said handle; and a fixing mechanism on said inner tube, wherein said first inner coaxial cone is attached to said first inner tube end, and wherein said second inner coaxial cone is attached to said second inner tube end.

17. The exercising device according to claim 16, wherein said first outer clip is fixed to said first outer coaxial cone and said first end of said handle by said inner tube, wherein said second outer clip is fixed to said second outer coaxial cone and said second end of said handle by said inner tube, and wherein said fixing mechanism is comprised of a locking key.

18. The exercising device according to claim 16, further comprising:

first inner ridges on said first inner coaxial ring and being in click-fit engagement with said first outer coaxial cone, wherein said means for releasably securing said first inner coaxial cone in a plurality of positions relative to said first outer coaxial cone is comprised of said first inner ridges and said first outer coaxial cone; and second inner ridges on said second inner coaxial ring and being in click-fit engagement with said second outer coaxial cone, wherein said means for releasably securing said second inner coaxial cone in a plurality of positions relative to said second outer coaxial cone is comprised of said second inner ridges and said second outer coaxial cone.

19. The exercising device according to claim 18, wherein said plurality of positions relative to said first outer coaxial cone is four, and wherein said plurality of positions relative to said second outer coaxial cone is four.

20. The exercising device according to claim 14, additionally having ribs or fins arranged along outer and/or inner cones in symmetric fashion relative to the handle axis, further comprising:

first outer ribs said first outer coaxial cone and in symmetrical arrangement coaxial to said handle, first inner fins along said first inner coaxial cone and in symmetrical arrangement coaxial to said handle, second outer ribs along said second outer coaxial cone and in symmetrical arrangement coaxial to said handle, and second inner fins along said second inner coaxial cone and in symmetrical arrangement coaxial to said handle.

21. The exercising device according to claim 14, further comprising:

a first outer flange along said first outer coaxial ring; and a second outer flange along said second outer coaxial ring.

* * * * *